US008727811B2

(12) United States Patent
Wang et al.

(10) Patent No.: US 8,727,811 B2
(45) Date of Patent: May 20, 2014

(54) ELECTRICAL CONNECTOR SOCKET AND PLUG HAVING TWO TRANSMISSION INTERFACES

(75) Inventors: Ching-Shun Wang, Taipei (TW); Chia-Ho Chang, Taipei (TW); Yuan-Bin Tang, Taipei (TW)

(73) Assignee: Advanced Connection Technology, Inc., New Taipei (TW)

( * ) Notice: Subject to any disclaimer, the term of this patent is extended or adjusted under 35 U.S.C. 154(b) by 42 days.

(21) Appl. No.: 13/550,979

(22) Filed: Jul. 17, 2012

(65) Prior Publication Data

US 2013/0164993 A1 Jun. 27, 2013

(30) Foreign Application Priority Data

Dec. 26, 2011 (TW) ..... 100224545 U
Jan. 4, 2012 (TW) ..... 101200152 U

(51) Int. Cl.
*H01R 24/28* (2011.01)

(52) U.S. Cl.
USPC ..... 439/660

(58) Field of Classification Search
USPC ..... 439/660, 676, 650, 541.5, 79, 639, 439/607.01
See application file for complete search history.

(56) References Cited

U.S. PATENT DOCUMENTS

D410,629 S * 6/1999 Bandura et al. ..... D13/147
6,758,685 B1 * 7/2004 Huang et al. ..... 439/79
7,427,217 B2 * 9/2008 Chou et al. ..... 439/660
7,607,926 B2 * 10/2009 Wang ..... 439/188
7,762,840 B2 * 7/2010 Hamner et al. ..... 439/541.5
7,988,495 B2 * 8/2011 Chung ..... 439/660
8,016,620 B1 * 9/2011 Chiu et al. ..... 439/660
8,038,474 B2 * 10/2011 Ju ..... 439/607.01
8,113,882 B1 * 2/2012 Chen ..... 439/607.01
8,215,996 B2 * 7/2012 Su et al. ..... 439/660
8,267,728 B2 * 9/2012 Nakaie et al. ..... 439/676
8,308,515 B2 * 11/2012 Chang ..... 439/660
2005/0048846 A1 * 3/2005 Suzuki et al. ..... 439/660
2009/0042448 A1 * 2/2009 He et al. ..... 439/650
2009/0186528 A1 * 7/2009 Chen ..... 439/660
2010/0173529 A1 * 7/2010 He et al. ..... 439/660
2011/0059656 A1 * 3/2011 Tsai ..... 439/660

(Continued)

FOREIGN PATENT DOCUMENTS

JP 2007-172907 A 7/2007
KR 20-0411207 Y1 3/2006
KR 20-2010-0004044 U 4/2010
KR 10-2010-0114471 A 10/2010

*Primary Examiner* — Alexander Gilman
(74) *Attorney, Agent, or Firm* — Muncy, Geissler, Olds & Lowe, P.C.

(57) ABSTRACT

An electrical connector socket includes an outer frame, an insulating base, first socket terminals, and second socket terminals. The outer frame includes a first and second insert space which respectively meets a first and second standard. The insulating base has a tongue including a first and second tongue portion. The thickness of the first tongue portion is different from that of the second tongue portion. One end of the first socket terminals is embedded in the base, and the other end is disposed at the first tongue portion and faces the first insert space. One end of the second socket terminals is embedded in the base, the other end of part of second socket terminals is disposed at the second tongue portion and faces the first insert space, and the other end of the other part is disposed at the second tongue portion and faces the second insert space.

8 Claims, 14 Drawing Sheets

(56) References Cited

U.S. PATENT DOCUMENTS

2012/0077390 A1* 3/2012 Tsai ..... 439/660
2013/0035001 A1* 2/2013 Yen et al. ..... 439/660
2013/0059479 A1* 3/2013 Ho ..... 439/639

* cited by examiner

ELECTRICAL CONNECTOR SOCKET AND PLUG HAVING TWO TRANSMISSION INTERFACES

CROSS-REFERENCES TO RELATED APPLICATIONS

This non-provisional application claims priority under 35 U.S.C. §119(a) on Patent Application No. 100224545 and 101200152 filed in Taiwan, R.O.C. on Dec. 26, 2011 and Jan. 4, 2012, the entire contents of which are hereby incorporated by reference.

BACKGROUND

1. Technical Field

The disclosure relates to an electrical connector and in particular to an electrical connector socket and plug having two transmission interfaces.

2. Related Art

Electrical devices are widely used, and their designs are increasingly low weight and small size. As a result, the volume of the electrical connector disposed in electrical devices must be reduced, especially for those requiring several electrical connectors meeting different kinds of signal transmitting standard respectively, so as to be capable of connecting with different kinds of connector plugs. Since each electrical connector occupies a certain volume and must be separated from each other, a waste of space typically results.

For example, if electrical devices for providing digital media information are installed with HDMI (High-Definition Multimedia Interface), socket connector, USB (Universal Serial Bus), socket connector, earphone socket connector, and microphone socket connector individually, considerable space is wasted by installing each of these socket connectors.

There is therefore a need for technicians in the art to integrate several electrical connectors, such as HDMI connectors and USB connectors, to save space occupied by electrical connectors. Additionally, a tamper resistant design must also be considered.

SUMMARY

Accordingly, an electrical connector socket including an outer frame, an insulting base, a plurality of first socket terminals, and a plurality of second socket terminal is provided. The outer frame includes a first insert space and a second insert space. The first insert space meets a first standard, and the second insert space meets a second standard. The insulating base includes a base and a tongue which is disposed in the outer frame. The tongue includes a first tongue portion and a second tongue portion which connects with the first tongue portion. The first tongue portion has a first thickness and connects to the base. The second tongue portion has a second thickness different from the first thickness. Each of the first socket terminals has one end embedded in the base, and has the other end disposed at the first tongue portion and facing the first insert space so as to transmit a first signal meeting the first standard. In one part of the second socket terminals, one end of each of the second socket terminals is embedded in the base, and the other end of that is disposed at the second tongue and facing the first insert space. In the other part of the second socket terminals, one end of each of the second socket terminal is embedded in the base, and the other end of that is disposed at the second tongue portion and facing the second insert space so as to transmit a second signal meeting the second standard.

The insulating base includes the tongue which has the first tongue portion and the second tongue portion, and the first socket terminals are disposed at the first tongue portion and facing the first insert space so as to transmit the first signal meeting the first standard. In addition, part of the second socket terminals has one end disposed at the second tongue portion and facing the first insert space, and part of the second socket terminals has one end disposed at the second tongue portion and facing the second insert space so as to transmit the second signal meeting the second standard. Therefore, one electrical connector socket is capable of having different transmitting interface. Further, the thickness of the first tongue portion is different from that of the second tongue portion and thereby forms a step which acts as a retaining surface to provide the function of tamper resistant.

It is to be understood that both the foregoing general description and the following detailed description presented below are intended to provide an overview or framework for understanding the nature and character of the disclosure as it is claimed. The accompanying drawings are included to provide a further understanding of the disclosure, and are incorporated into and constitute a part of this specification. The drawings illustrate various embodiments of the disclosure, and together with the description serve to explain the principles and operations of the disclosure.

BRIEF DESCRIPTION OF THE DRAWINGS

The disclosure will become more fully understood from the detailed description given herein below for illustration only, and thus not limitative of the present invention, wherein.

DETAILED DESCRIPTION

Figure 1:
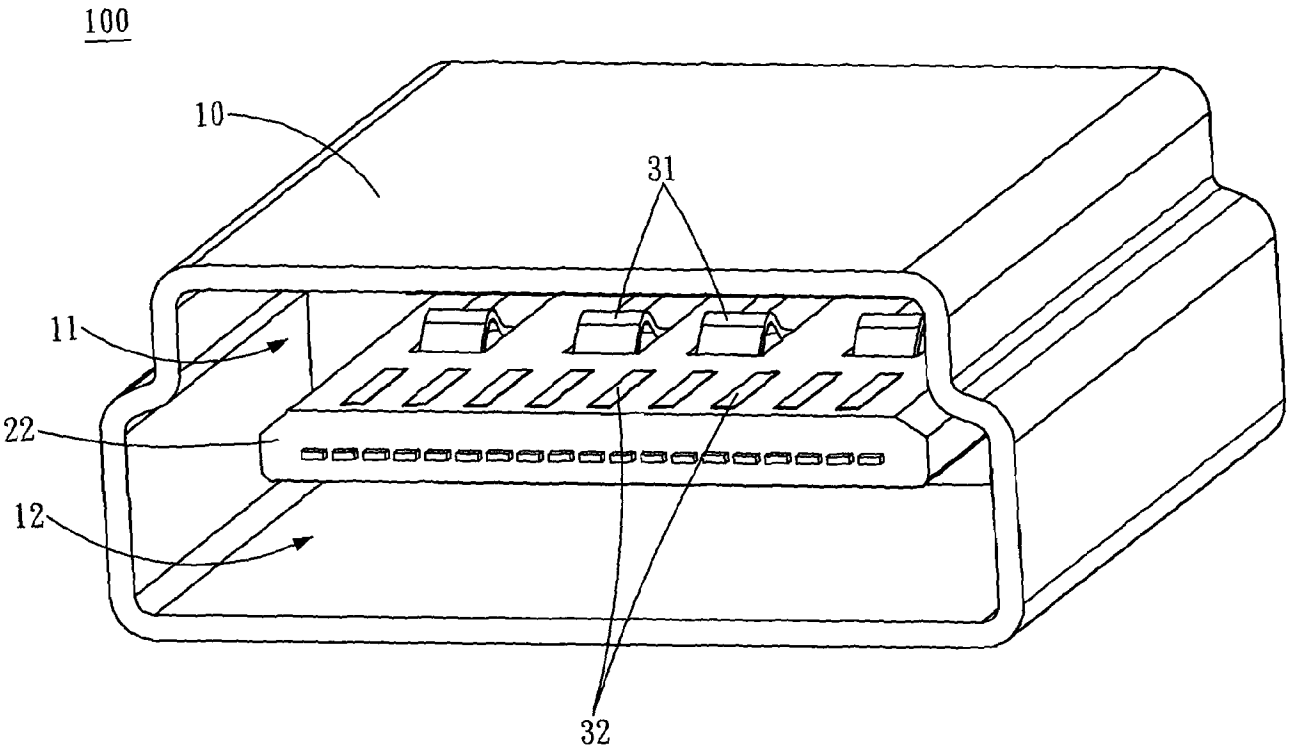
FIG. 1 is a schematic three-dimensional view of the first embodiment.
Figure 2:
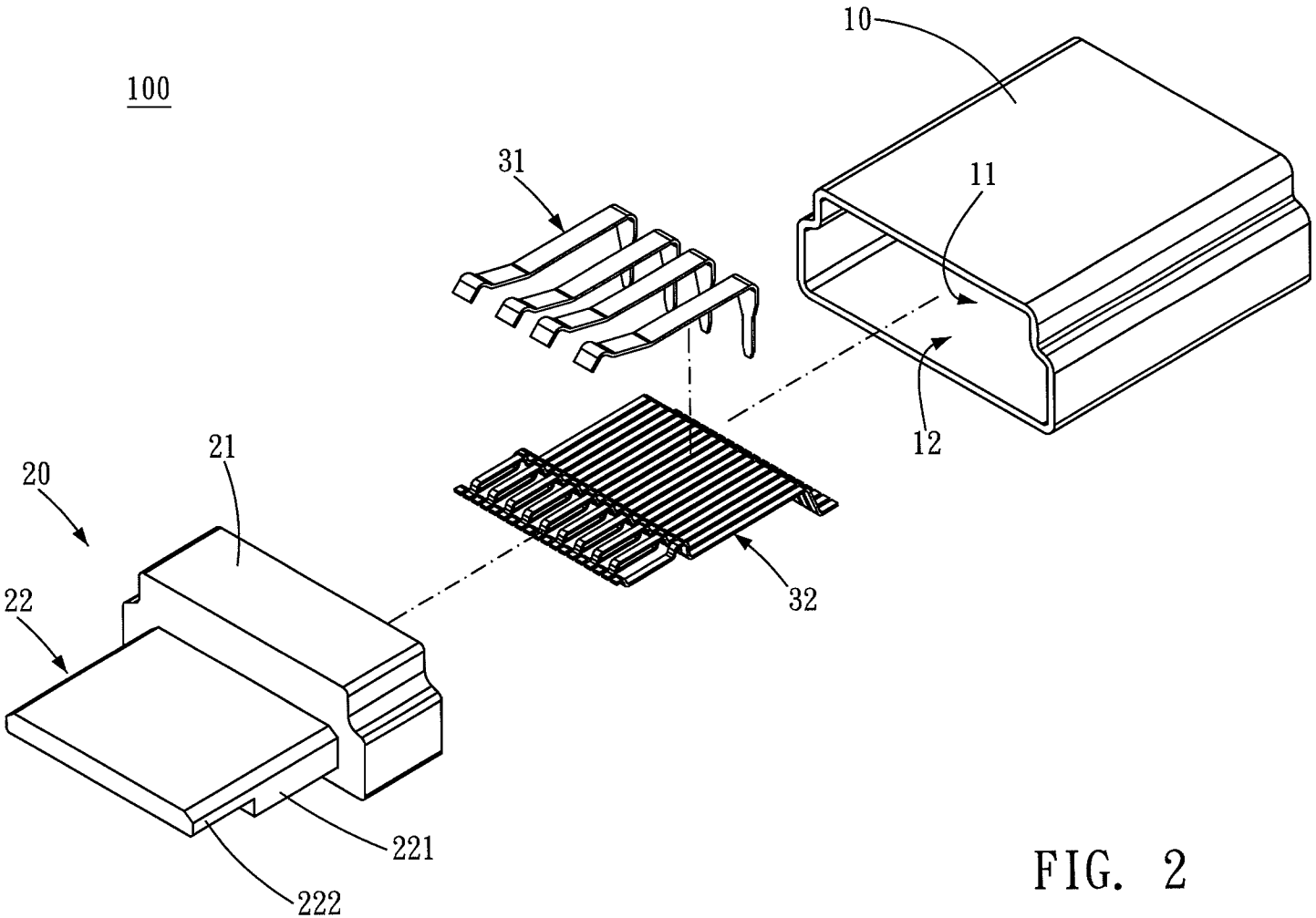
FIG. 2 is a schematic exploded view of the first embodiment.
Figure 3:
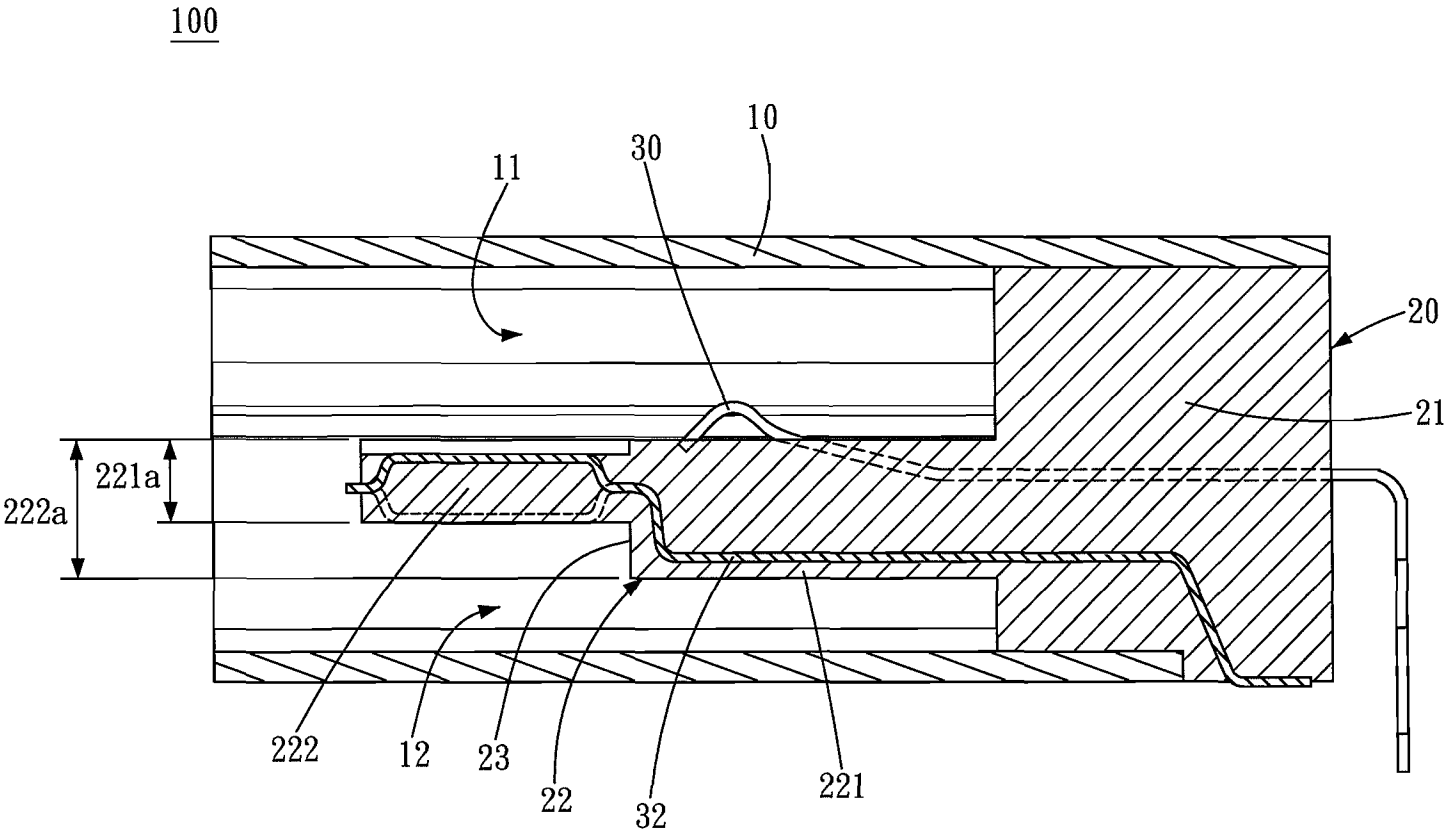
FIG. 3 is a schematic cross-sectional view of the first embodiment.

Please refer to FIG. 1, FIG. 2, and FIG. 3, which are a schematic three-dimensional view, an exploded view, and a cross-sectional view of the first embodiment respectively. According to the first embodiment, an electrical connector socket 100 for connecting with a first connector plug meeting the first standard or a second connector plug meeting the second standard is disclosed. The electrical connector socket 100 of the embodiment is capable of being only inserted by a normal first connector plug meeting the first standard (ex. USB signal), as well as being only inserted by a normal second connector plug meeting the second standard (ex. HDMI signal). The electrical connector socket 100 includes an outer frame 10, an insulating base 20, a plurality of first socket terminals 31, and a plurality of second socket terminals 32.

Outer frame 10 includes first insert space 11 and second insert space 12. The shape of the frame opening appears to be a reverse letter "T". In this embodiment, first insert space 11 meets the first standard, and second insert space 12 meets the second standard. Further, the first standard is preferably the USB (Universal Serial Bus), and the second standard is preferably the HDMI (High-Definition Multimedia Interface). Also, the size of first insert space 11 of first standard (USB) is smaller than second insert space 12 of the second standard (HDMI).

Insulating base 20 is preferably an insulating object made by plastic. Insulating base 20 is disposed in outer frame 10 and includes base 21 and tongue 22. Preferably, tongue 22 is monolithically formed by an extension of one side of base 21. Tongue 22 includes first tongue portion 221 and second tongue portion 222. First tongue portion 221 has first thickness 221*a* and connects to base 21. Second tongue portion 222 has second thickness 222*a* different from first thickness 221*a*. In this embodiment, first thickness 221*a* is larger than second thickness 222*a*.

First socket terminals 31 are disposed at insulating base 20 and embedded in base 21 with one end. First socket terminals 31 preferably are combined with insulating base 20 by insert molding or in a separable manner. The other end of each of first socket terminals 31 is disposed at first tongue portion 221 and faces first insert space 11 so as to transmit the first signal meeting the first standard. This means that first socket terminals 31 transmit USB signals, and the other end of each of first socket terminals 31 disposed at first tongue 221 is exposed. It should be noted that the other end of each of first socket terminals 31 is capable of being disposed at the upper surface or bottom surface of first tongue portion 221.

Second socket terminals 32 are disposed at insulating base 20. In this embodiment, each of second socket terminals 32 is embedded in base 21 with one end. In one part of second socket terminals 32, the other end of that is disposed at second tongue portion and facing first insert space 11. In the other part of second socket terminals 32, the other ends of that is disposed at second tongue portion 222 and facing second insert space 12 so as to transmitting the second signal meeting the second standard, which is HDMI signals. One end of each of socket terminals 32 interlacedly faces first insert space 11 or faces second insert space 12. This means that in two adjacent second socket terminals 32, their ends face different insert space respectively. Second socket terminals 32 preferably are combined with insulating base 20 by insert molding or in a separable manner. The other end of each second socket terminals 32 disposed at second tongue portion 222 is exposed.

The number of first socket terminals 31 is configured to meet the first standard so as to transmit the first signal meeting the first standard. The number of second socket terminals 32 is configured to meet the second standard so as to transmit the second signal meeting the second standard. However, one skilled in the art is able to alter the number of terminals to transmit more kind of signals.

Please refer to FIG. 3, which is a cross-sectional view of the first embodiment. A flat surface is formed at one side of first tongue portion 221 and second tongue portion 222 and facing first insert space 11. A step is formed at the other side of that and faces second insert space 12. Preferably, tongue 22 further includes retaining surface 23 at the step which is between first tongue portion 221 and second tongue portion 222. This means that first tongue portion 221 is located at the up half of the second tongue portion 222, and one surface of first tongue portion 221 is at the same level with second tongue portion 222. In this embodiment, whole electrical connector socket 100 includes a first height, and electrical connector plug 200 is capable of being inserted into electrical connector socket 100 by the first height.

In another embodiment, a step is capable of being formed at one side of first tongue portion 221 and second tongue portion 222 and faces first insert space 11. Another step is formed at the other side of that and facing second insert space 12. Tongue 22 further includes retaining surface 23 which is disposed at the step between first tongue portion 221 and second tongue portion 222. This means that first tongue portion 221 is located at the central position of second tongue portion 222 such that first tongue portion 221 is not at the same level with second tongue portion 222. In this embodiment, whole electrical connector socket 100 includes a second height. Therefore, the position of first insert portion 60 of electrical connector plug 200 is altered as electrical connector plug 200 is inserted into electrical connector socket 100. Accordingly, the second height of electrical connector socket 100 in this embodiment is larger than the first height of electrical connector socket 100 in the first embodiment. It should be noted that the relative position between first tongue portion 221 and tongue portion 222 can be altered according to the practical requirements.

In one example, one side of the above-mentioned first tongue portion 221 and second tongue portion 222 is formed as a step which faces second insert space 12. Tongue 22 further includes retaining surface 23 which is located at the step between first tongue portion 221 and second tongue portion 222. This means that the bottom of first tongue portion 221 is at the same level with the bottom of second tongue portion 222, and the top of first tongue portion 221 is not at the same level with the top of second tongue portion 222. In this embodiment, whole electrical connector socket 100 includes a third height. Therefore, the position of first insert portion 60 of electrical connector plug 200 is altered as electrical connector plug 200 is inserted into electrical connector socket 100. Accordingly, the third height of the whole electrical connector socket 100 in this embodiment is larger than the second height of electrical connector socket 100 in the second embodiment.

Figure 4:
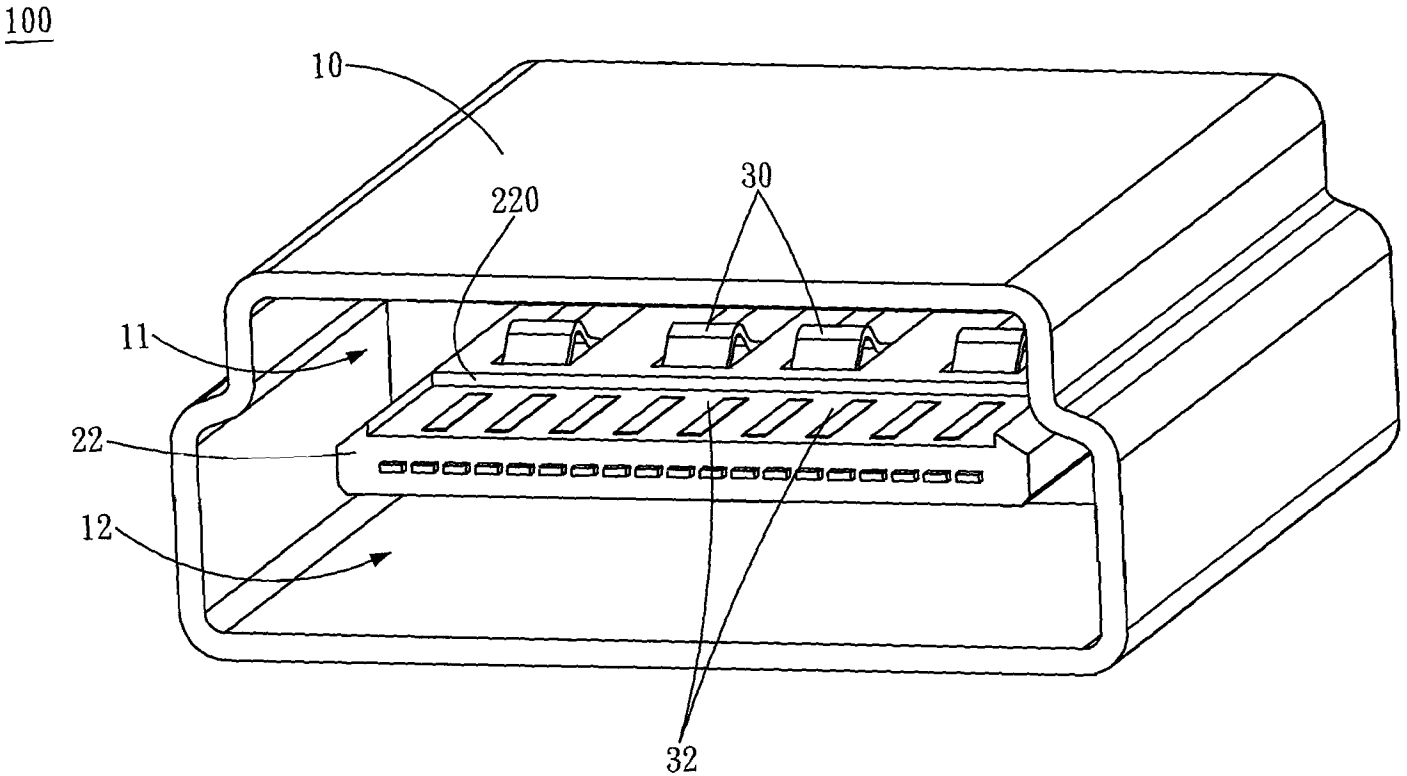
FIG. 4 is a schematic three-dimensional view of the second embodiment.

Please refer to FIG. 4, which is a schematic three-dimensional view of second embodiment. The primary difference between the second embodiment and the first embodiment is described below. Tongue 22 includes a groove 220 located at second tongue portion. In one part of second socket terminals 32, one end of each of socket terminals 32 is disposed in groove 220 and faces first insert space 11 or second insert space 12. One end of each of second socket terminals 32 is exposed by groove 220. The surface of groove 220 is not at the same level with the surface of first tongue portion 221 such that second socket terminals 32 will not be touched as first plug terminals 80 of electrical connector plug 200 touch first socket terminals 31. Hence, a short-cut issue or signal-interference resulting from static electrical is avoided.

Figure 5:
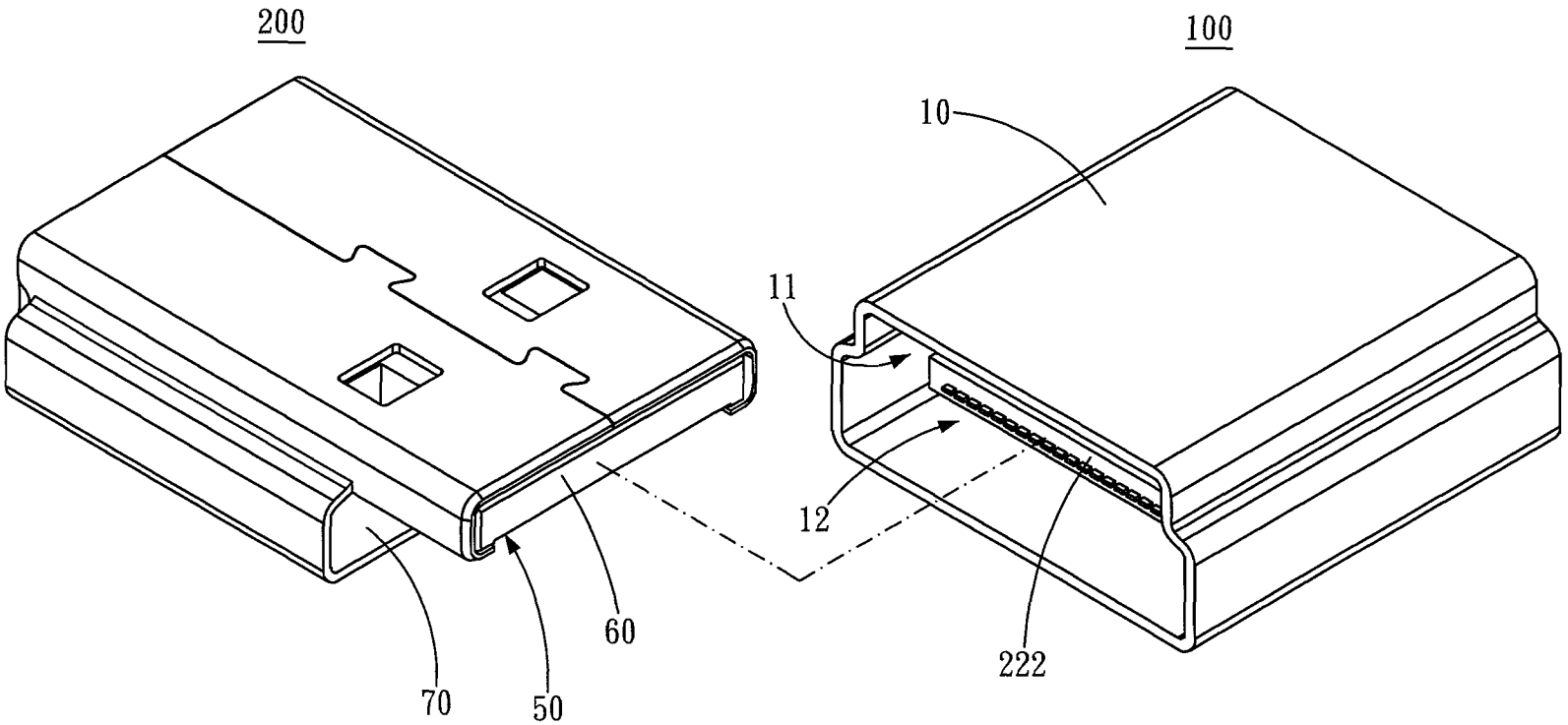
FIG. 5 is a schematic three-dimensional view of the third embodiment.
Figure 6:
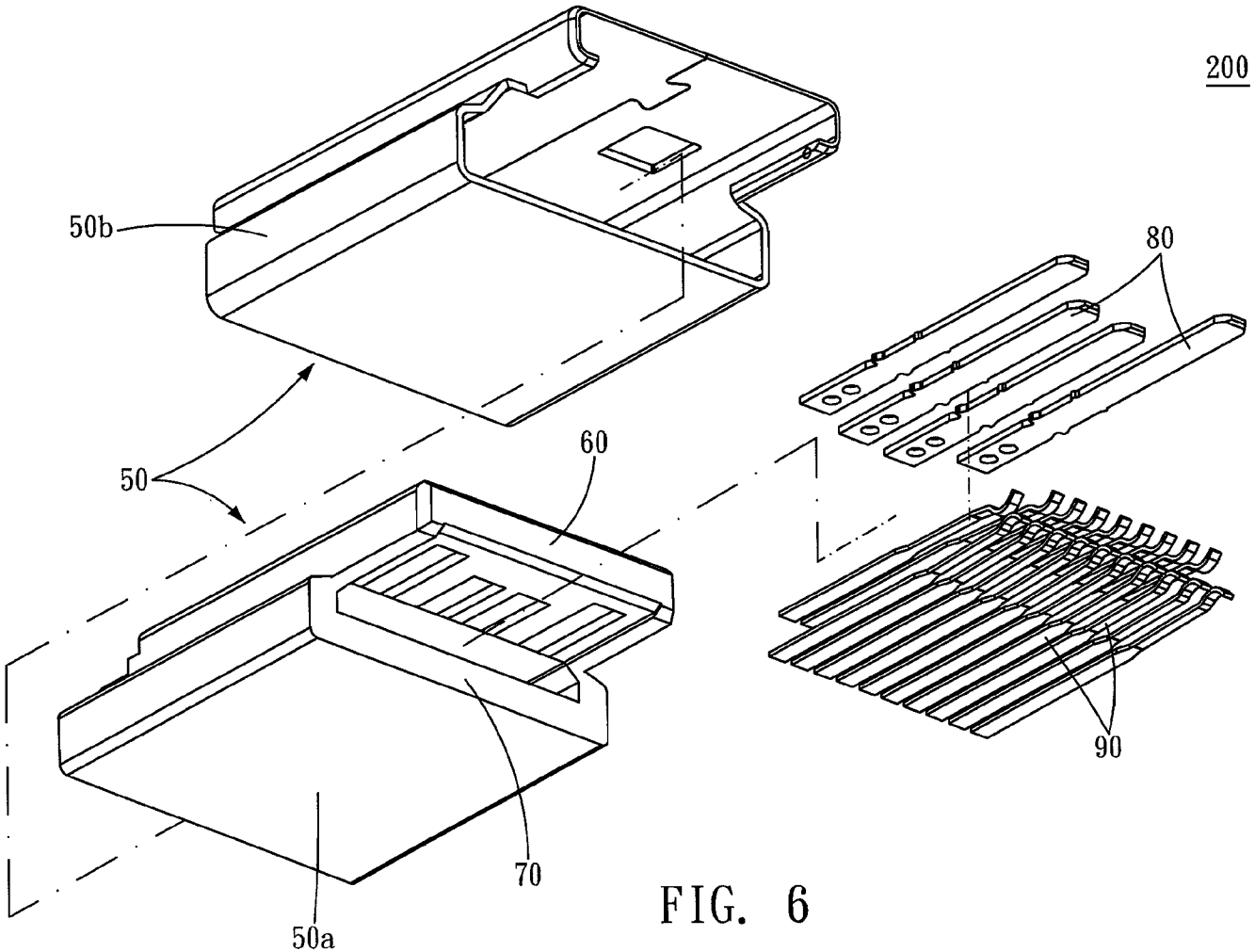
FIG. 6 is a schematic exploded view of the plug of the third embodiment.

Please refer to FIG. 5 and FIG. 6, which are illustrations of one embodiment of electrical connector socket 100 and electrical connector plug 200. In this embodiment, electrical connector plug 200 for connecting with electrical connector socket 100 of first embodiment, and for providing the first signal and second signal described in first embodiment is disclosed.

Electrical connector plug 200 includes main body 50, first insert portion 60, second insert portion 70, a plurality of first plug terminals 80, and a plurality second plug terminals 90.

Main body 50 includes insulating base 50*a* and shell 50*b*. First insert portion 60 connects to main body 50 and meets the first standard so as to be inserted into first insert space 11. Second insert portion 70 connects to main body 50 and meets the second standard so as to be inserted into second insert space 12. First plug terminals 80 are disposed at first insert portion 60. One part of second plug terminals 90 are disposed at first insert portion 60, and the other part of second plug terminals 90 are disposed at second plug portion 70 and facing first plug terminals 80 which are disposed at first plug portion 60.

Figure 7:
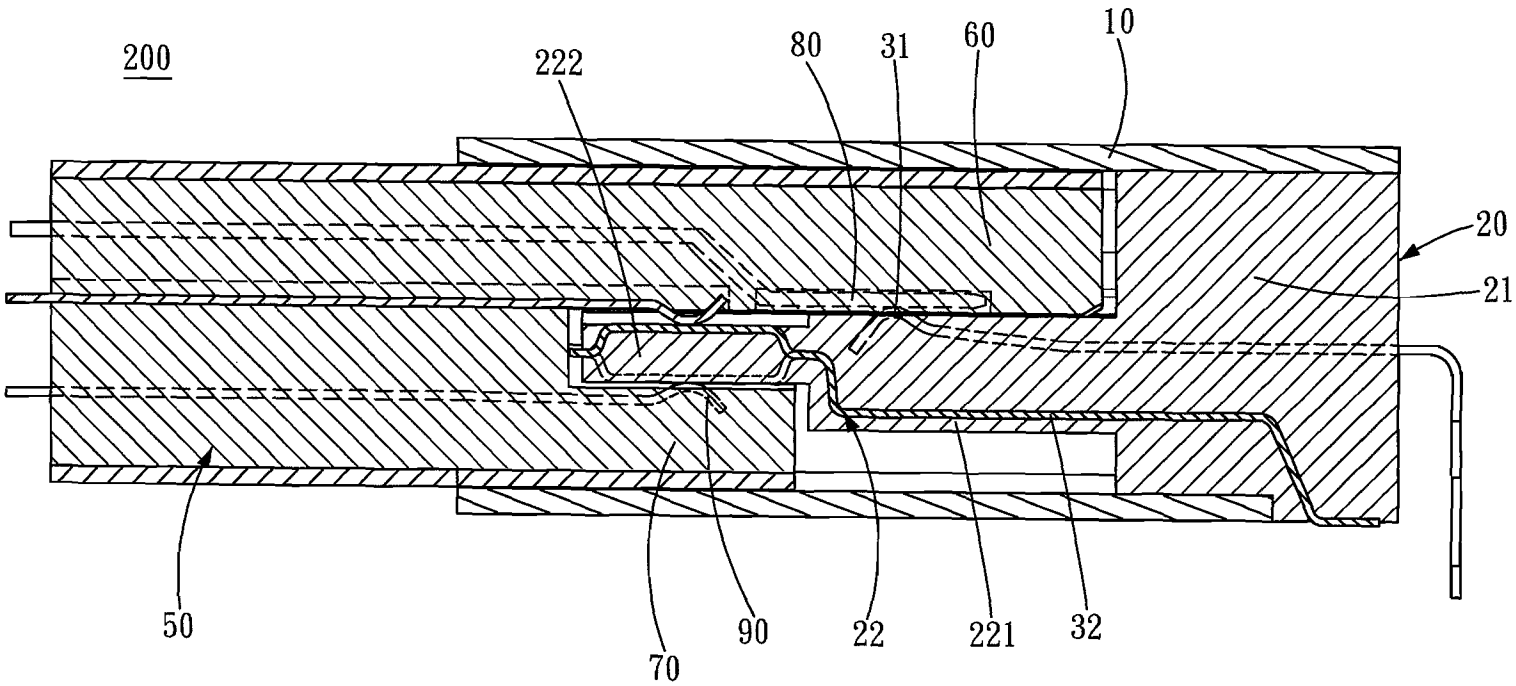
FIG. 7 is a schematic cross-sectional view of the plug and the socket of the third embodiment.

Please refer to FIG. 7, as electrical connector socket 100 connects to electrical connector plug 200, first insert portion 60 is inserted into first insert space 11 and abutted against first socket terminals 31 so as to transmit the first signal meeting the first standard. In addition, second insert portion 70 is inserted into second insert space 12 and abutted against second socket terminals 32 so as to transmit the second signal meeting the second standard.

It should be noted that the shape of first insert portion 60 of electrical connector plug 200 is corresponding to the shape of first insert space 11 of electrical connector socket 100 in the first embodiment. If the positions of first insert space 11 and second insert space 12 in the first embodiment are exchanged, then the positions of first insert portion 60 and second insert portion 70 in this embodiment are exchanged correspondingly.

Figure 8:
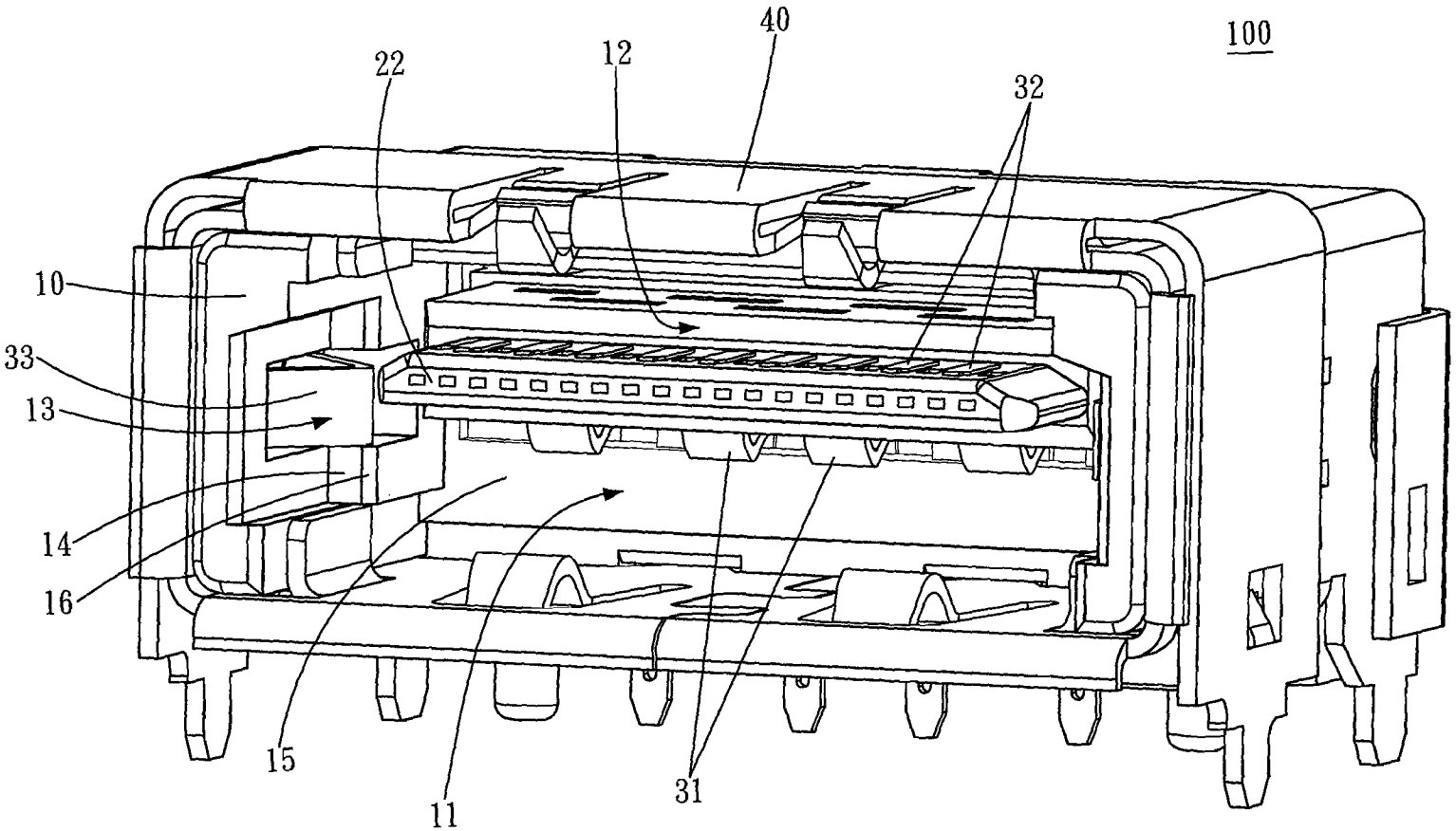
FIG. 8 is a schematic three-dimensional view of the fourth embodiment.
Figure 9:
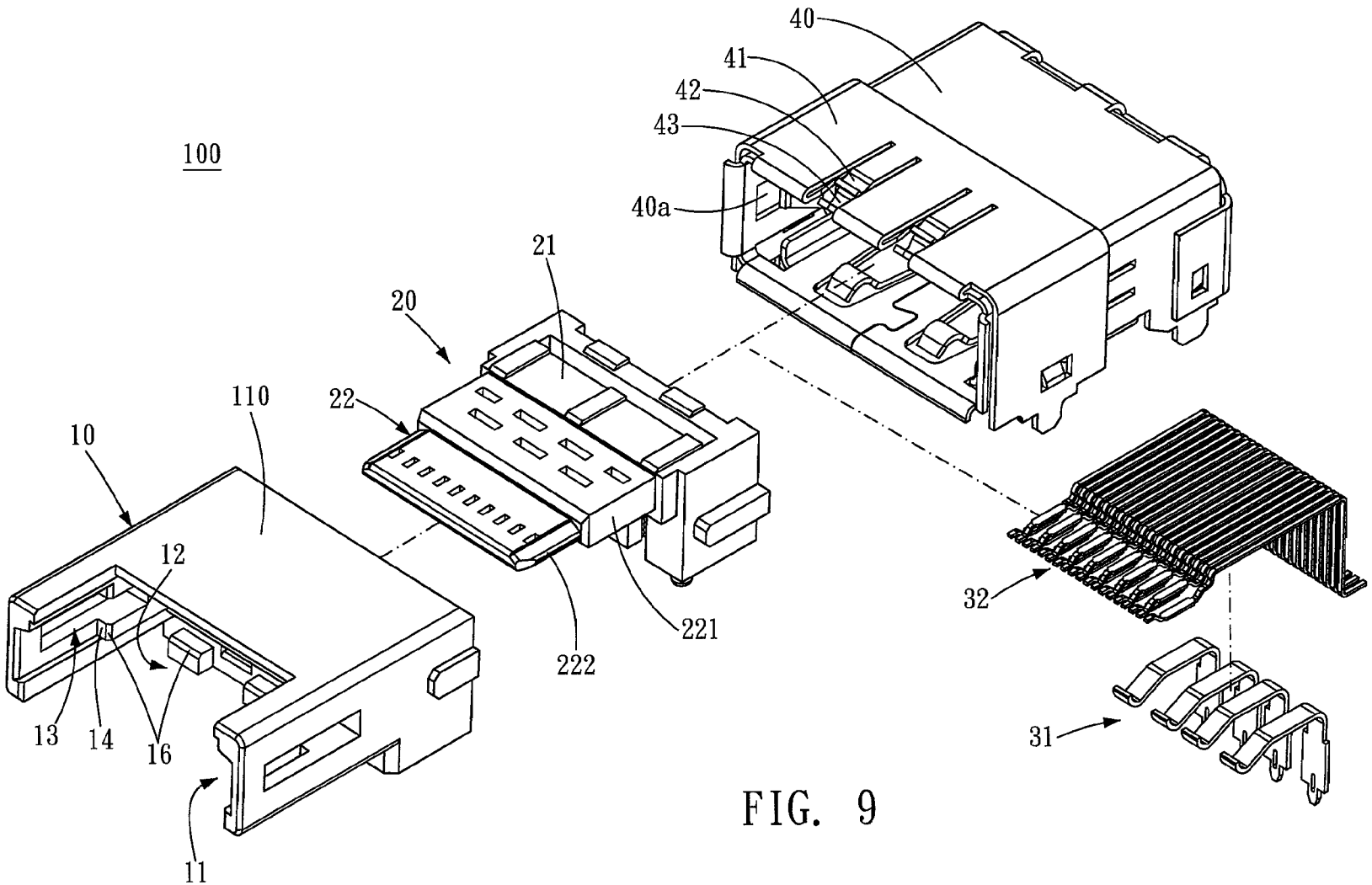
FIG. 9 is a schematic exploded view of the fourth embodiment.
Figure 10:
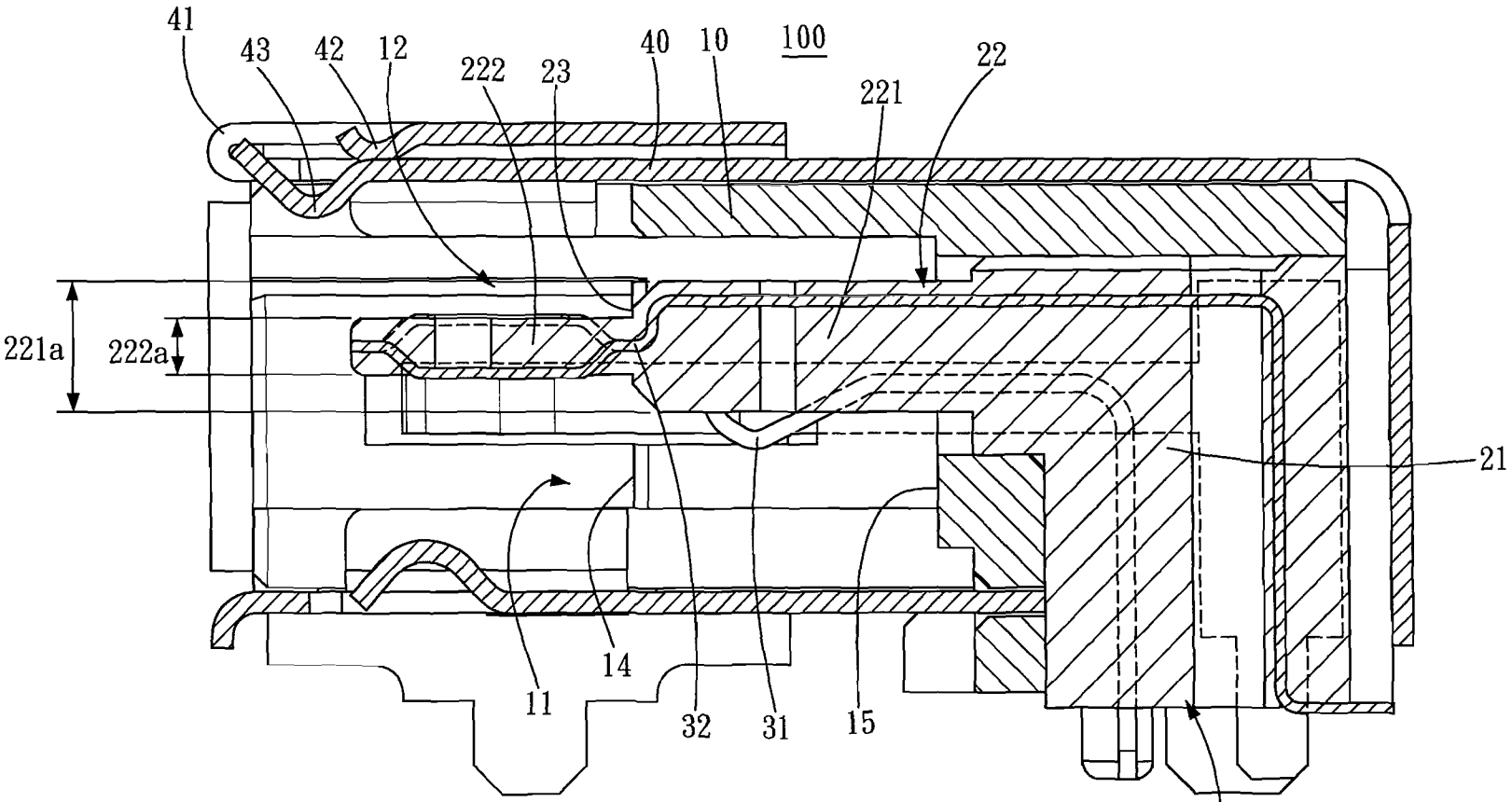
FIG. 10 is a schematic cross-sectional view of the fourth embodiment.

Please refer to FIG. 8, FIG. 9, and FIG. 10, which are the schematic three-dimensional view, exploded view, and cross-sectional view of the fourth embodiment of the disclosure. The primary difference between this embodiment and the first embodiment is that electrical connector socket 100 includes a structure for switching the transmitting pattern between the first signal and the second signal, and outer frame 10 of electrical connector 110 includes plastic frame base 110.

Plastic frame base 110 includes first insert space 11 and second insert space as outer frame 10 which is disclosed in the first embodiment. The frame opening appears to be a reverse letter "T". In this embodiment, plastic frame base 110 further includes first abutment surface 14 and second abutment surface 15 (as shown in FIG. 8). First abutment surface 14 is located at the inner wall of first insert space 11. As electrical connector plug 200 meeting the first standard is inserted into first insert space 11, it is retained by first abutment surface 14. As electrical connector plug 200 meeting the second standard is inserted into second insert space 12, it is retained by second abutment surface 15. In addition, plastic frame base 110 includes a plurality of guiding inclines 16 (as shown in FIG. 9) which are disposed in first insert space 11 and second insert space 12. As electrical connector plug 200 meeting first standard or second standard is inserted into first insert space 11 and second insert space 12, guiding incline 16 guide the electrical connector plug to be positioned in a right direction. It should be noted that as the electrical connector plug is inserted into the electrical connector socket, it is inserted into both of first insert space 11 and second insert space 12.

Insulating base 20, a plurality of first socket terminals 31, and a plurality of second socket terminals 32 in this embodiment are the same as those described in the first embodiment, hence unnecessary detail in this is no longer given.

Please refer to FIG. 9 and FIG. 10, in which shell 40 of electrical connector socket 100 includes folding plate 41, reinforcement end 42, and abutment end 43. Abutment end 43 is located at the wall nearby the inlet of electrical connector socket 100 and is extending in the plastic frame base 110. Folding plate 41 is formed by folding part of shell 40 reversely onto abutment end 43. Reinforcement 42 is located at folding plate 41 and abutting against abutment end 43. As electrical connector plug 200 is inserted into electrical connector socket 100, abutment end 43 is abutted against it to avoid electrical connector plug 200 from loosening or falling off. Therefore, even though the thickness of shell 40 is reduced, the clamping force of abutment end 43 is still remained. Reducing the thickness of shell 40 serves the practical purpose of saving cost and reducing the volume of electrical connector socket 100.

Figure 11:
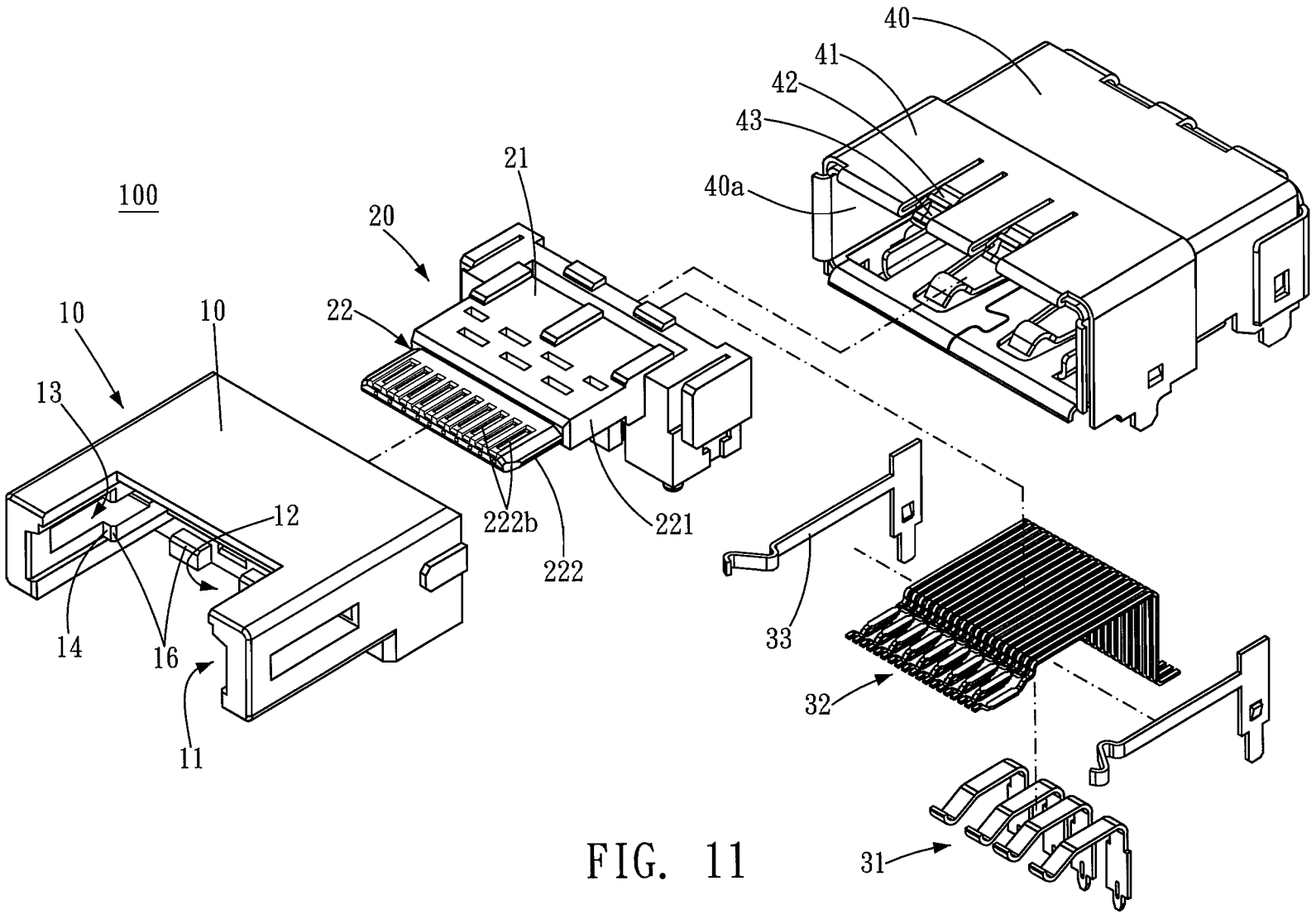
FIG. 11 is a schematic exploded view of the fifth embodiment.
Figure 13:
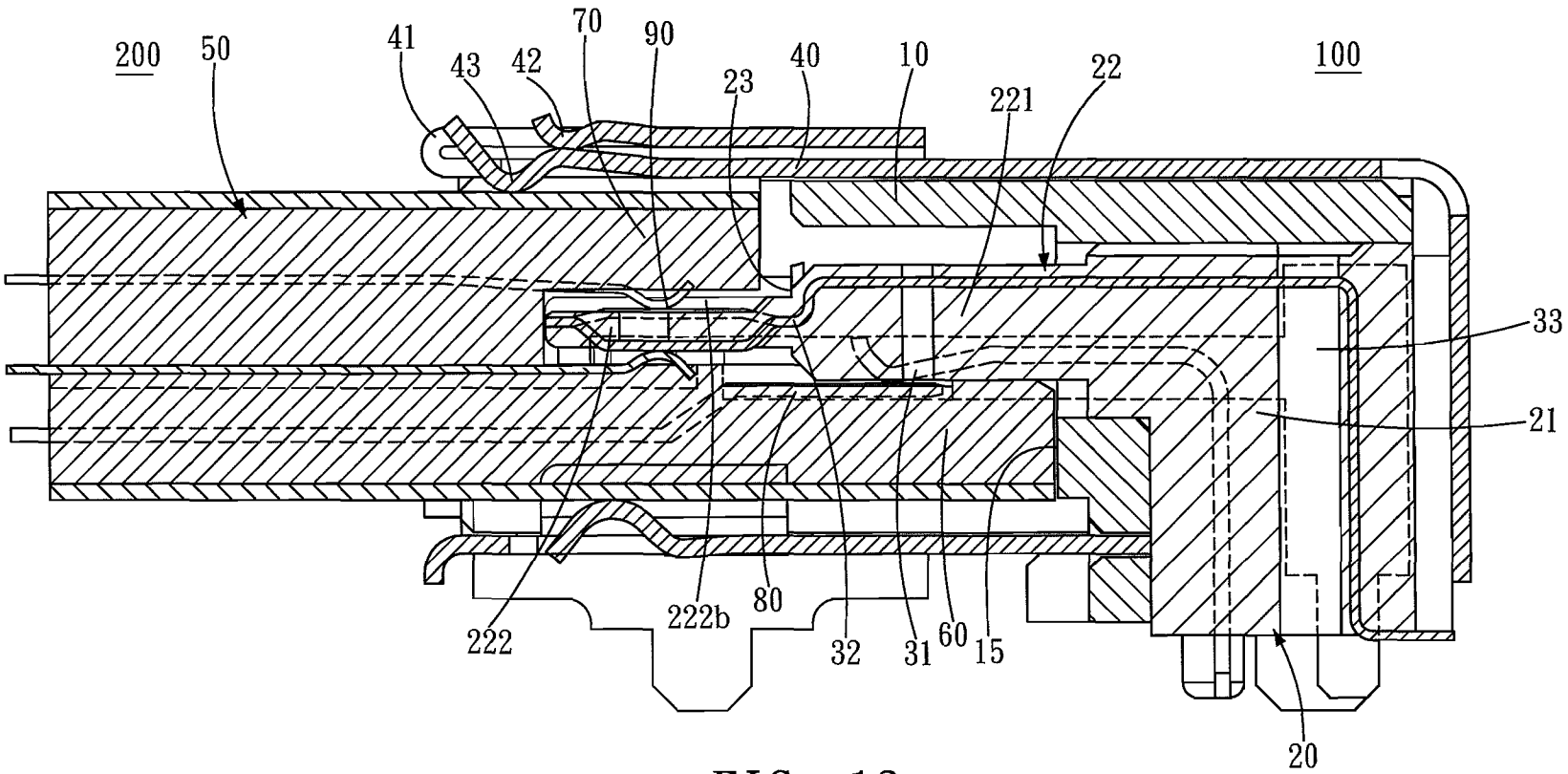
FIG. 13 is a schematic exploded view of the plug of the sixth embodiment.

Please refer to FIG. 11, which is the schematic exploded view of fifth embodiment. The primary difference between this embodiment and the fourth embodiment is that electrical connector socket 100 in this embodiment further includes third socket terminal 33. One end of third socket terminals 33 is embedded in base 21, and the other end of that is located at abutment area 13. Abutment area 13 of plastic frame base in this embodiment is located at the sidewall, but not limited to it. In one practical use, it can be located on the interior surface. As electrical connector plug 200 is inserted into electrical connector socket 100 (as shown in FIG. 13), one end of third socket terminals 33 elastically contact shell 50*b* of electrical connector plug 200 and side surface 40*a* of shell 40. It provides electrical contact, but the signal loop is closed. The other end of third socket terminals 33 transmits the signals to the outer electrical circuit board and the control chip thereon so as to process the signals such like switching transmitting pattern between the first signal and the second signal, or acting as detection pins.

Please refer to FIG. 11, in which second tongue portion 222 includes a plurality of partitions 222*b* in a form of indentation. Partitions 222*b* are configured to be disposed on with the other end of each of second socket terminals 32. Additionally, when one side of first tongue portion 221 is at the same level with second tongue portion 222, partitions 222*b* provide a function of short-cut proof.

Figure 12:
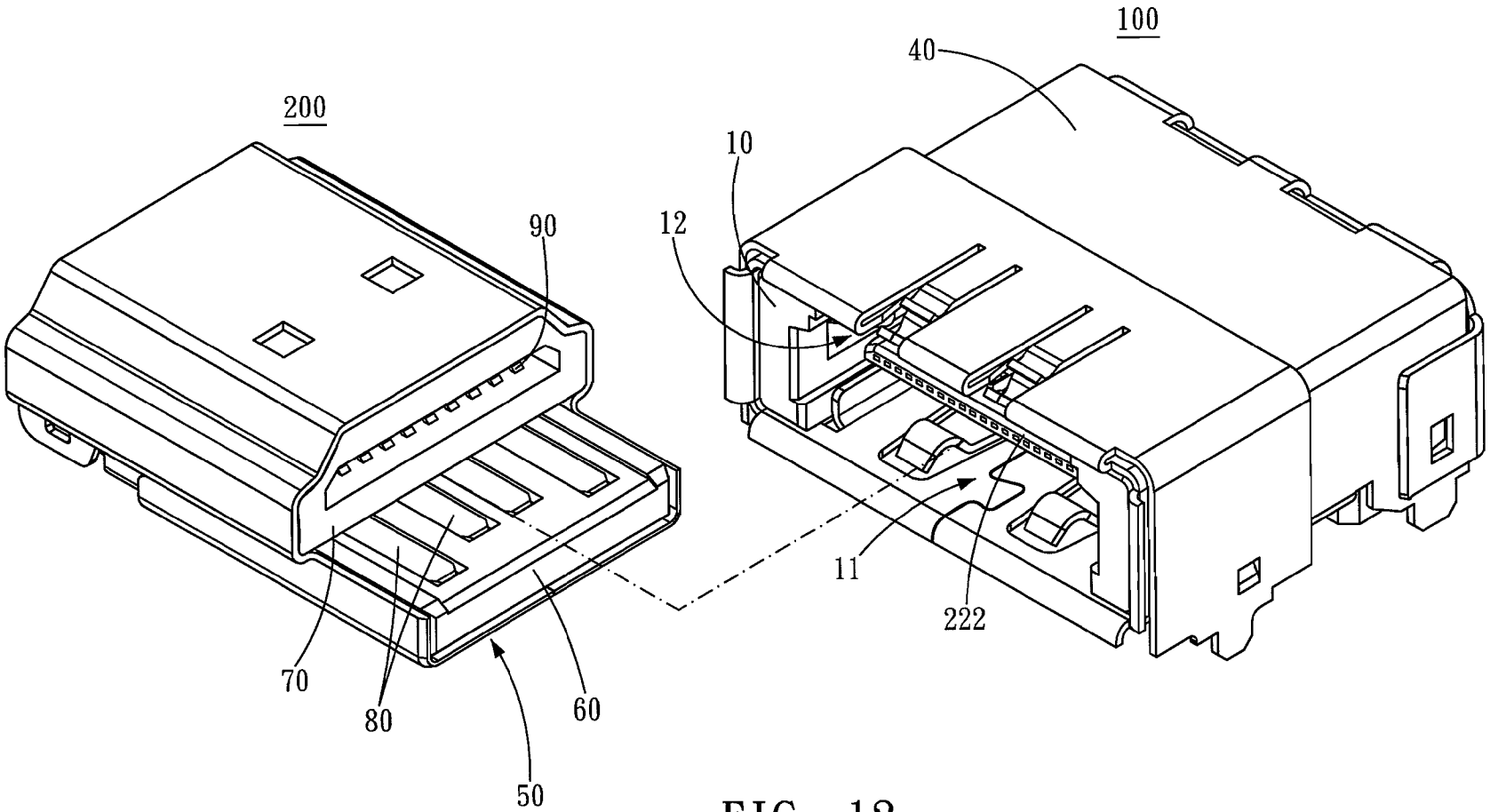
FIG. 12 is a schematic three-dimensional view of the sixth embodiment.
Figure 14:
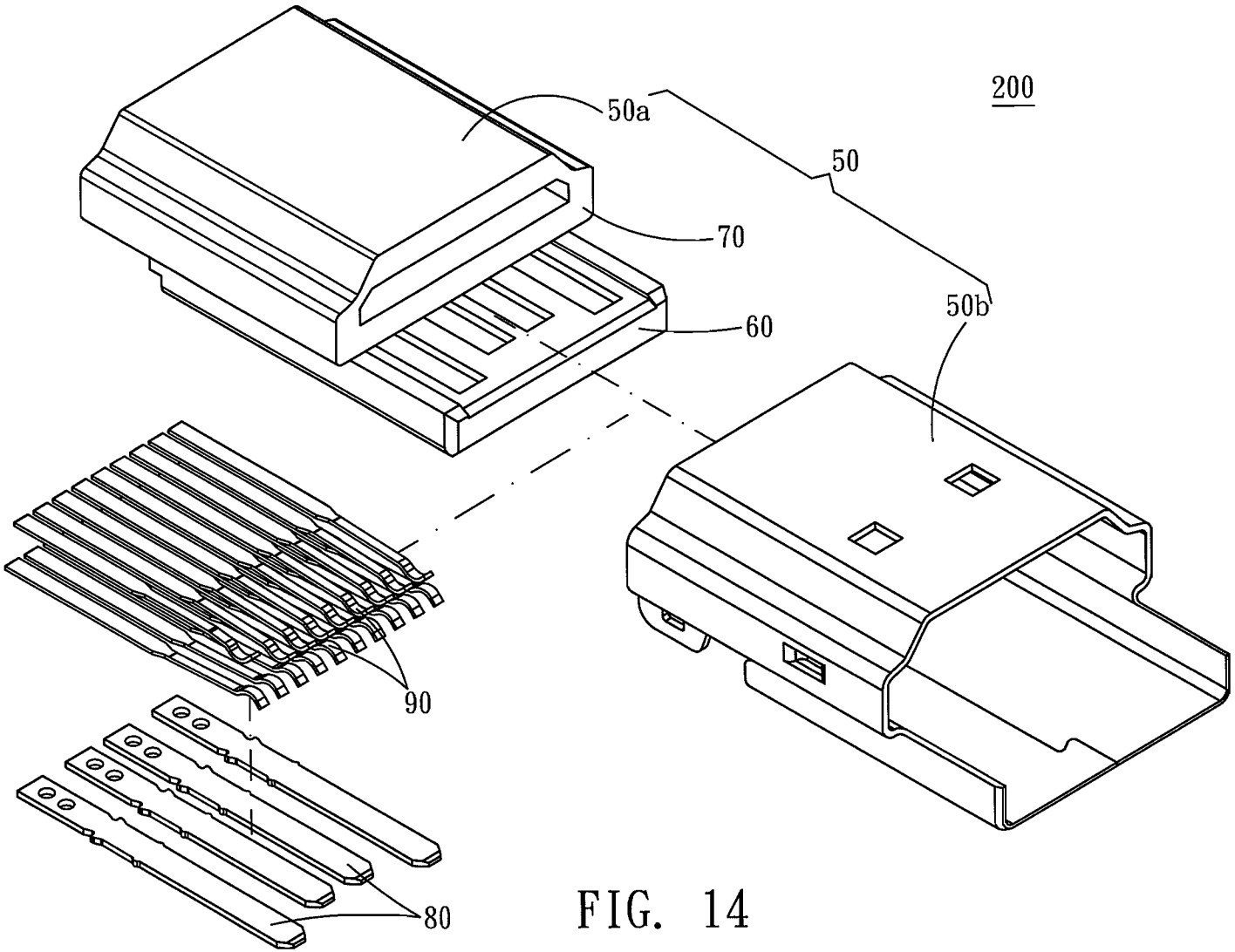
FIG. 14 is a schematic cross-sectional view of the plug and the socket of the sixth embodiment.

Please refer to FIG. 12 and FIG. 14, which are illustrations of one embodiment of electrical connector socket 100 and electrical connector plug 200. In this embodiment, electrical connector plug 200 for connecting with electrical connector socket 100 in the first embodiment, and for transmitting the first signal and the second signal disclosed in the first embodiment is disclosed.

Electrical connector plug 200 includes main body 50, first insert portion 60, second insert portion 70, a plurality of first plug terminals 80, and a plurality of second plug terminals 90.

Main body 50 includes insulating base 50*a* and shell 50*b*. First insert portion 60 connects to main body 50. First insert portion 60 meets the first standard of plug standard so that can be inserted into first insert space 11. Second insert portion 70 connects to main body 50. Second insert portion 70 meets second standard of plug standard so that can be inserted into second insert space 12. First plug terminals 80 are located at first insert portion 60. One part of second plug terminals 90 is located at first insert portion 60. The other part of second plug terminals 90 is located at second insert portion 70 and facing first plug terminals of first insert portion 60.

As electrical connector socket 100 connects to electrical connector plug 200, first insert portion 60 is inserted into first fame opening 11 and abutted against first socket terminals 31 to transmit the first signal meeting the first standard. In addition, second insert portion 70 is inserted into second insert space 12 and abutted against second socket terminals 32 so as to transmit the second signal meeting the second standard.

The tongue of the insulting base includes a first tongue portion and second tongue portion connecting with each other. First socket terminals are located at first tongue portion and face the first insert space so as to transmit the first signal meeting the first standard. One part of second socket terminals is located at second tongue portion and facing the first insert space. The other part of that is located at second tongue portion and facing the second insert space so as to transmit the second signal meeting the second standard. Accordingly, one electrical connector socket is capable of having different transmitting interfaces. In addition, the step resulted from the thickness difference between the first tongue portion and the second tongue portion provides a function of tamper resistant, which prevents users from inserting unsuitable connector plug into the connector socket. Furthermore, folding plate is formed from the shell to increase the clamping force of the abutment end thereby thins the shell to save the cost and reduce the volume of whole electrical connector socket. An electrical connector plug is also provided to connect with the above-mentioned electrical connector socket and to transmit the first signal and the second signal.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector socket with two transmitting interfaces, for connecting with a first electrical connector plug meeting a first standard or connecting with a second electrical connector plug meeting a second standard, comprising:

an outer frame, comprising a first insert space and a second insert space, the first insert space meets the requirement of the first standard, the second insert space meets the requirement of the second standard, the outer frame comprises a plastic frame base or a shell, the plastic frame base comprises an abutment area, located at the inner wall of the first insert space or the second insert space;

an insulating base, disposed in the outer frame, comprising a base and a tongue, the tongue comprises a first tongue portion and a second tongue portion connecting with each other, the first tongue portion has a first thickness and connects to the base, the second tongue portion has a second thickness different from the first thickness;

a plurality of first socket terminals, having one end located at the first tongue portion and facing the first insert space so as to transmit a first signal meeting the first standard; and a plurality of second socket terminals, partially having one end located at the second tongue portion and facing the first insert space, and partially having one end located at the second tongue portion but facing the second insert space so as to transmit a second signal meeting the second standard.

2. The electrical connector socket with two transmitting interfaces according to claim 1, wherein the tongue comprises an retaining surface located at the step between the first tongue portion and the second tongue portion.

3. The electrical connector socket with two transmitting interfaces according to claim 1, wherein the tongue comprises a groove located at the second tongue portion, and one end of part of the second socket terminals is located at the groove and facing the first insert space or the second insert space.

4. The electrical connector socket with two transmitting interfaces according to claim 1, further comprising a third socket terminal, one end of the third socket terminal is embedded in the base and the other end is located at the abutment area.

5. The electrical connector socket with two transmitting interfaces according to claim 1, wherein the plastic frame base further comprises:

a first abutment surface, located at the inner wall of the first insert space, the first abutment surface is configured to retain a first electrical connector plug meeting the first standard; and a second abutment surface, located at the inner wall of the second insert space, the second abutment surface is configured to retain a second electrical connector plug meeting the second standard.

6. The electrical connector socket with two transmitting interfaces according to claim 1, wherein the shell comprises:

an abutment end, extending in the plastic frame base;

a folding plate, overlapped and located on the abutment end; and a reinforcement end, located at the folding plate and abutting against the abutment end.

7. The electrical connector socket with two transmitting interfaces according to claim 1, wherein the second tongue portion comprising a plurality of partitions, located at the surface and facing the first insert space or the second insert space, the partitions are configured to be disposed with the other end of the second socket terminals.

8. An electrical connector plug with two transmitting interfaces, for connecting with the electrical connector socket according to claim 1, transmitting the first signal and the second signal, comprising:

a main body;

a first insert portion, connecting to the main body, meeting the first standard so as to be capable of being inserted into the first insert space;

a second insert portion, connecting the main body, meeting the second standard so as to be capable of being inserted into the second insert space;

a plurality of first plug terminals, located at the first insert portion, abutting against the first socket terminals to transmit the first signal meeting the first standard as the first insert portion is inserted into the first insert space; and a plurality of second plug terminals, one part is located at the first insert portion, the other part is located at the second insert portion and faces the first plug terminals and the first socket terminals located at the first insert portion, the second plug terminals abut against the second socket terminals to transmit the second signal meeting the second standard.

* * * * *